United States Patent [19]

Van Horssen

[11] Patent Number: 4,881,978

[45] Date of Patent: Nov. 21, 1989

[54] HAND HELD SWIMMING POOL TILE DESCALER

[76] Inventor: Charles A. Van Horssen, 9233 N. 12 Avenue, Phoenix, Ariz. 85021

[21] Appl. No.: 140,720

[22] Filed: Jan. 4, 1988

[51] Int. Cl.[4] ..... C23G 3/00; B08B 1/04

[52] U.S. Cl. ..... 134/16; 15/93 R; 15/93 C; 15/209 B; 15/210 B; 210/169

[58] Field of Search ..... 134/16; 15/93 C, 93 R, 15/210 B, 209 B; 210/169

[56] References Cited

U.S. PATENT DOCUMENTS 3,417,417 12/1968 Rhodes ..... 15/93 R 3,708,880 1/1973 Norfleet ..... 15/93 R

*Primary Examiner*—Asok Pal

*Attorney, Agent, or Firm*—Tod R. Nissle

[57] ABSTRACT

Hand held water powered apparatus for removing scale from the tile circumscribing a swimming pool at the waterline of the pool.

2 Claims, 2 Drawing Sheets

HAND HELD SWIMMING POOL TILE DESCALER

The invention relates to apparatus for removing calcium and other mineral deposits or scale from a surface.

More particularly, the invention pertains to hand held water powered apparatus for removing scale from the tile circumscribing a swimming pool at the waterline of the pool.

Swimming pools are constructed with a ring of ceramic tile which circumscribes the pool at the waterline of the pool. When water evaporates from the pool, calcium and other mineral deposits accumulate on these ceramic tile and must, in order to preserve the appearance of the pool, be removed. Various types of abrasive pads and materials have been developed for removing scale from swimming pool ceramic tile. Such abrasive materials generally require a pool ownerto enter water in the pool or to kneel beside the pool in a position which permits the pool owner to physically press the abrasive material against the tile while moving the material over the tile. Consequently, removing the scale from swimming pool tile or other surfaces is an awkward, undesirable task which has often caused the user of conventional abrasive materials to scrape the knuckles of his or her hand or strain his or her back and neck. In addition, when the thickness of mineral deposits on swimming pool tile becomes relatively thick, removing the deposits can take a very long time.

Accordingly, it would be highly desirable to provide an improved method and apparatus for readily removing scale from the ceramic tile of a swimming pool, the method not requiring that a user continually physically apply substantial pressure to abrasive material while moving the material up, down and around the surface of the tile.

Therefore, it is a principal object of the invention to provide an improved method and apparatus for cleaning scale from the ring of ceramic tile circumscribing the waterline of a swimming pool.

Another object of the invention is to provide improved scale removal apparatus of the type described which includes reciprocating parts for impacting and fracturing scale and which is powered by water flowing through the apparatus.

A further object of the invention is to provide improved scale removal apparatus which, while being compact and readily grasped in the hand, does not require either the manual application of great pressure or the up and down and circular movement of the hand over the surface being descaled.

These and other, further and more specific objects and advantages of the invention will be apparent to those skilled in the art from the following detailed description thereof, taken in conjunction with the drawings, in which.

Briefly, in accordance with my invention, I provide improved hand held apparatus for removing scale from the title on a swimming pool. The apparatus includes a housing; a plurality of pins mounted for reciprocation in the housing, each pin including a distal end which at the farthest extent of reciprocation of the pin extends outwardly from the housing; at least one blade operatively associated with a shaft rotatably mounted in the housing; first orifice means for directing fluid under pressure into the housing against the blade to displace the blade and rotate the shaft; transmission means operatively associated with the shaft to selectively sequentially apply motive power to the pins; and, second orifice means permitting fluid entering the housing through the first orifice means to exit the housing.

In another embodiment of my invention I provide a method for removing scale from the tile on a swimming pool, the method including the steps of manually grasping descaler apparatus; attached a hose to the apparatus; pumping water from the swimming pool through the apparatus; and, holding the descaler apparatus against the pool tile to loosen scale thereon. The descaler apparatus includes a housing; a plurality of pins mounted in the housing, each pin including a distal end which extends outwardly from the housing; at least one blade operatively associated with a shaft rotatably mounted in the housing; first orifice means for directing fluid under pressure into the housing against the blade to displace the blade and rotate the shaft; transmission means operatively associated with the shaft to selectively sequentially apply motive power to the pins; and, second orifice means permitting fluid entering the housing through the first orifice means to exit the housing. The first end of the hose is attached to the first orifice means. The second end of the hose is immersed in water in the swimming pool. Water is pumped from the swimming pool through the hose into the first orifice means, through the housing, and outwardly from the housing through the second orifice means. When the descaler apparatus is held adjacent the pool tile the reciprocating pins contact the tile and loosen scale therefrom.

Figure 1:
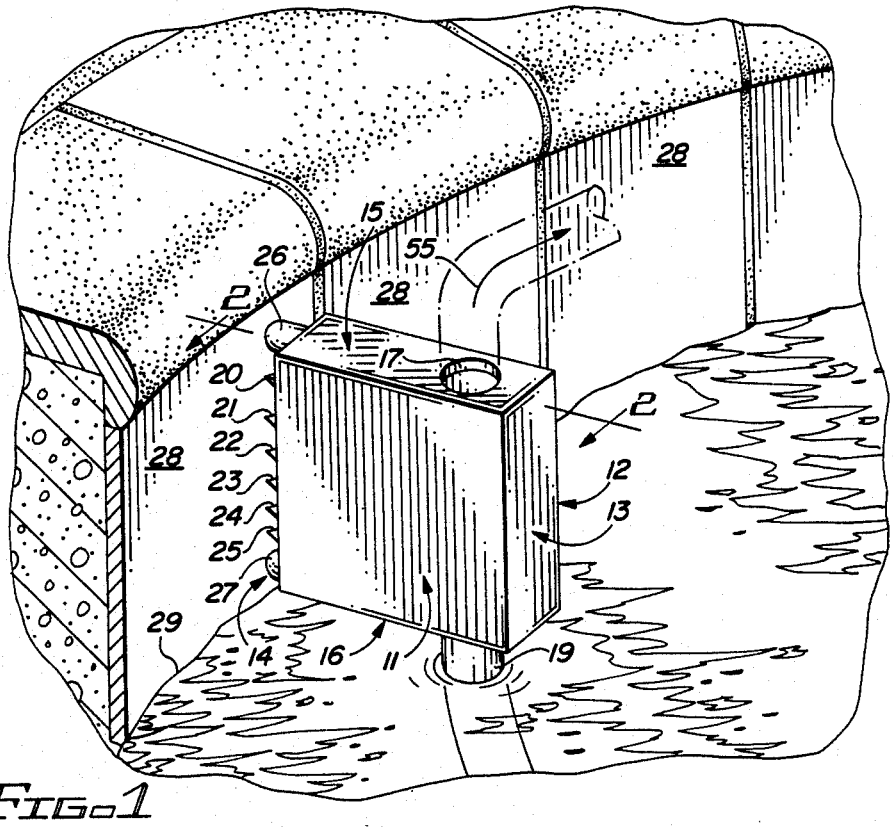
FIG. 1 is a perspective view illustrating scale removal apparatus constructed in accordance with the principles of the invention and illustrating the mode of operation thereof.
Figure 2:
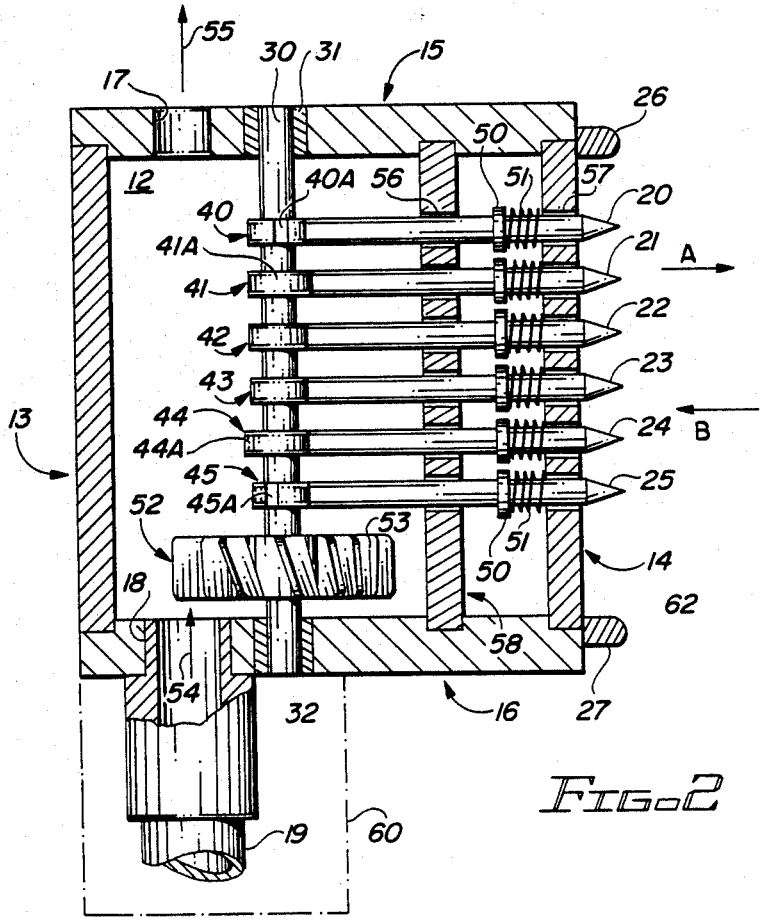
FIG. 2 is a section view of the scaling apparatus of FIG. 2 further illustrating interior construction details thereof.
Figure 3:
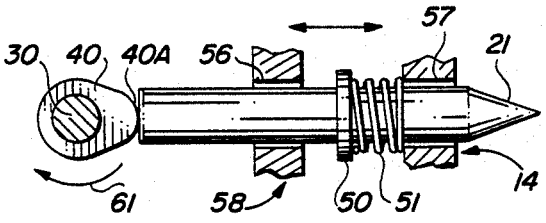
FIG. 3 is a side view of one of the impact pins of FIG. 2 illustrating the mode of operation thereof.

Turning now to the drawings, in which the presently preferred embodiments of the invention are shown for the purpose of illustrating the practice thereof and not by way of limitation of the scope of the invention and in which like reference characters identify corresponding elements throughout the several views, the descaling apparatus of FIGS. 1 to 3 includes a housing having rectangular front 11, back 12, sides 13 and 14, top 15 and bottom 16. Conduit 17 is formed through top 15. Conduit 18 is formed through bottom 16. Hose 19 is attached to conduit 18. Pins 20, 21, 22, 23, 24, 25 are mounted in the housing for reciprocation therein. Spacers 26 and 27 fixedly secured to side 14 have rounded tips which readily slide over the surface of ceramic pool tile 28 circumscribing a swimming pool at the normal waterline 29 of the pool. Tiles 28 extend above and beneath waterline 29. An outlet hose 30 may be connected to orifice 17.

In FIG. 3, one end of shaft 30 is rotatably mounted in bushing 31 of top 15 while the other, smaller diameter end of cylindrical shaft 30 is mounted in bushing 32 in bottom 16. Cams 40 and 45 are fixedly mounted on shaft 30. Each cam 40 to 45 is identical in shape and dimension and is mounted on shaft 30 spaced apart from the other cams. Each cam 40 to 45 has a high point or tip 40A to 45A which is farther away from shaft 30 than any other point on the cam 40 - 45. Cams 40 to 45 are positioned on shaft 30 such that tips 40A to 45A generally lie an imaginary spiral line and, as shaft 30 rotates, sequentially cause pins 20 to 25 to be displaced away from shaft 30. Each pin 20 to 25 includes a collar 50 fixedly attached thereto. A spring 51 is compressed between each collar 50 and side 14.

Water turbine 52 is fixedly attached to shaft 30 and includes a plurality of spaced apart canted blades 53. Water flowing through conduit 19 and into the housing in the direction of arrow 54 strikes blades 53 and causes the water turbine 52 and, accordingly, shaft 30 to rotate. Water entering the housing through conduit 19 and orifice 18 travels through the housing and exits through orifice 17 in the direction of arrow 55.

Figure 4:
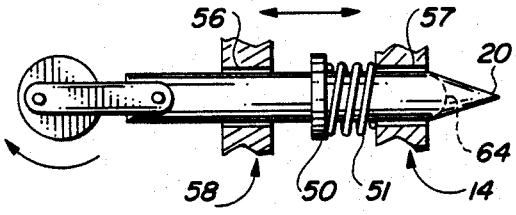
FIG. 4 is a side view of one of the impact pins of FIG. 2 illustrating an alternative means of supplying motive power thereto.

Each pin 20 to 25 slidably extends through an aperture 57 in side 14 and an aperture 56 in plate 58. In FIGS. 2 to 4, apertures 56 and 57 are, for the sake of clarity, depicted as being significantly larger than the diameter of each pin 20 to 25. It is preferred each aperture 56, 57 be of a diameter slightly larger than the diameter of the pin 20 to 25 extending therethrough. Apertures 56, 57 can be coated with teflon or other friction-reducing agents to facilitate the sliding reciprocation of a pin through the aperture.

In operation of the apparatus of FIGS. 1 to 3, water is directed through conduit 19 in the direction of arrow 54. A pump (not shown) attached to hose 19, a pump 60 attached to the housing, or any other appropriately positioned pump means is utilized to direction water through hose 19 under pressure. Water traveling into the housing of the apparatus in the direction of arrow 54 flows against and contacts the canted blades of water turbine 52, causing turbine 52 and shaft 30 to rotate. As shaft 30 rotates, cams 40 to 45 mechanically sequentially apply motive power to and displace pins 20 to 25 outwardly in the direction of arrow A and allow each pin to return in the direction of arrow B to its normal resting position. In FIG. 2, pin 21 has been displaced to the furthest point of travel in the direction of arrow A because the tip 41A of cam 41 is contacting the lower end of pin 41 and forcing pin 21 outwardly. When cam 41 forces pin 41 outwardly, collar 50 is also forced in the direction of arrow A and further compresses the resilient spring 51 intermediate collar 50 and side 14. When, in FIGS. 2 and 3, shaft 30 continues to rotate in the direction of arrow 61 (FIG. 3), tip 41A rotates away from pin 21 and spring 51 forces pin 21 against cam 41 in the direction of arrow B. As pin 21 moved in the direction of arrow B, the tip 42A of cam 42 begins to contact the bottom of pin 22 and displace pin 22 outwardly in the direction of arrow A. After tip 42A rotates past the bottom of pin 22, spring 51 begins to force pin 22 in the direction of arrow B, and cam 43 begins to displace pin 23 in the direction of arrow A, etc. Consequently, pins 20–25 are continually sequentially individually displaced while shaft 30 rotates. Cams 40 to 45 can be placed on shaft 30 to reciprocate pins 20 to 25 in any desired selected sequence. In FIG. 2, the pins reciprocate in the order of 20, 21, 22, 23, 24, 25, 20, etc. The order of reciprocation could be 20, 22, 24, 23, 25, 20, 22, 24, 23, 25, etc., or any other desired order. A pin could be reciprocated two or more times before another pin is reciprocated. Two or more pins can be reciprocated simultaneously. Each pin 20–25 is, in the presently preferred embodiment of the invention, displaced a relatively short distance of travel in moving from its normal position of rest (illustrated by pins 20, 22–25 in FIG. 2) to the furthest extent of outward displacement (illustrated by pin 21 in FIG. 2). This outward displacement distance of travel can be increased if desired. It is, however, important that when a sharp tipped pin 20–25 is at the furthest extent of outward travel it only protrudes past the ends of spacers 26 and 27 a small distance, otherwise the pins may crack tile 28. In FIG. 2, dashed line 62 indicates the face of a tile 28 when spacers 26, 27 are contacting the tile. When the pointed tips of pins 20 to 25 are outwardly displaced they contact and loosen scale on the face of swimming pool tiles 28. Pins 20 to 25 can contact scale on the tile prior to being outwardly displaced by a cam 40 to 45. The shaft 30—cam 40–45 transmission can be replaced by a transmission which would, like a jackhammer, apply motive power by sequentially striking each pin 20 and 25 without requiring the pins 20 to 25 actually be outwardly displaced a selected distance. Such a jackhammer type transmission would function to transmit vibrational forces through a pin which was contacting scale when the pin was in its normal position of rest and would also force the pin against the scale.

Figure 5:
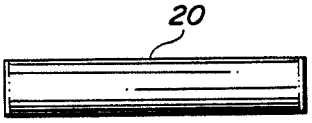
FIG. 5 is a side view illustrating an alternate embodiment of one of the pins of the apparatus of FIG. 2.

The tip of a pin 20–25 does not have to be pointed in the manner illustrated in FIGS. 2 and 3. The tip can be rounded as indicated by dashed line 64 in FIG. 4, or can be flat as shown in FIG. 5.

Figure 7:
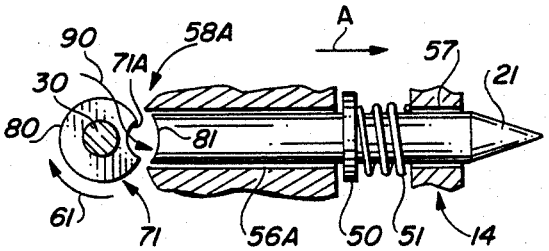
FIG. 7 is a side elevation view of one of the impact pins of FIG. 6 illustrating the mode of operation thereof; and, FIG. 8 is a side elevation view of one of the impact pins of FIG. 6 further illustrating the mode of operation thereof.
Figure 8:
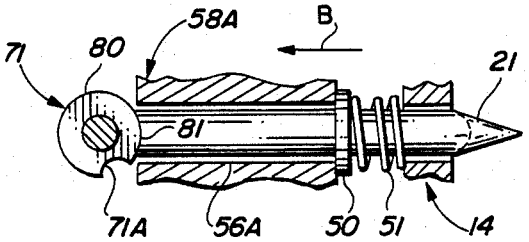
Figure 6:
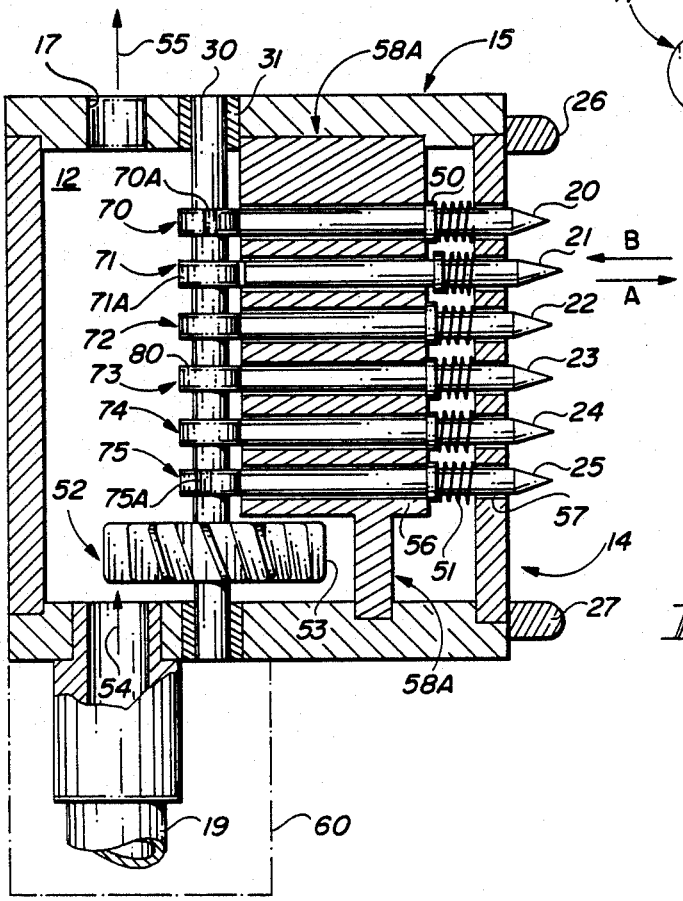
FIG. 6 is a section view illustrating an alternate embodiment of the descaling apparatus of FIG. 2.

An alternate embodiment of the invention is illustrated in FIGS. 6–8 and includes many of the components illustrated in FIGS. 1–3. The apparatus of FIGS. 6 to 8 includes, as modification to the apparatus of FIGS. 1 to 3, member 58A with apertures 56A formed therethrough and sized to slidably receive pins 20 to 25. Cylindrical members 70 to 75 are fixedly mounted on shaft 30 and each have a single semicircular indent 70A to 75A formed therein. The bottom portions of pins 20 to 25 are concave and shaped to slidably conform to the outer diameter 80 of members 70 to 75, respectively. Indents 70A to 75A lie along an imaginary spiral line. When an indent 70A to 75A is positioned immediately beneath a pin as illustrated in FIG. 7, water flows through the indent in the manner indicated by arrow 90 and provides motive power to upwardly displace the pin. As shaft 30 continues to rotate and indent moves from underneath the pin, the cylindrical outer surface 80 of member 71 slidably sealingly moves over the concave surface 81 of pin 21 and generally prevents water pressure from acting on pin 21. When surface 80 completely covers surface 81, pin 21 moves in the direction of arrow B to the normal resting position illustrated in FIG. 8. Accordingly, when shaft 30 in FIG. 6 rotates, pins 20 to 25 are sequentially reciprocated in the same order as pins 20 to 25 in FIG. 2.

The transmission means (i.e. members 70 to 75) carried on shaft 30 in FIG. 6 reciprocates pins 20 to 25 by applying and removing water pressure to and from the pins. The transmission means (i.e., cams 40 to 45) carried on shaft 30 in FIG. 2 reciprocates pins 20 to 25 by mechanically applying and removing pressure to and from the pins.

As used herein, the term "motive power" indicates a force applied to an impact pin 20 to 25 to cause the pin to move and/or be forced against scale on a surface.

Having described my invention in such terms as to enable those skilled in the art to understand and practice it, and having identified the presently preferred embodiments thereof, I claim:

1. Hand-held apparatus for removing scale from the tile on a swimming pool, said apparatus including (a) a housing;

(b) a plurality of pins mounted for reciprocation in said housing, each pin including a distal end which at the farthest extent of reciprocation of said pin extends outwardly from said housing;

(c) at least one blade operatively associated with a shaft rotatably mounted in said housing;

(d) first orifice means for directing fluid under pressure into said housing against said blade to displace said blade and rotate said shaft;

(e) transmission means operatively associated with said shaft for selectively sequentially applying motive power to said pins to force said pins against said scale; and, (f) second orifice means permitting fluid entering said housing through said first orifice means to exit said housing.

2. A method for removing scale from the tile on a swimming pool, said method including the steps of (a) manually grasping descaler apparatus, said descaler apparatus including (i) a housing, (ii) a plurality of pins mounted in said housing, each pin including a distal end which extends outwardly from said housing, (iii) at least one blade operatively associated with a shaft rotatably mounted in said housing, (iv) first orifice means for directing fluid under pressure into said housing against said blade to displace said blade and rotate said shaft, (v) transmission means operatively associated with said shaft for selectively sequentially applying motive power to said pins to force said pins against said scale; and (vi) second orifice means permitting fluid entering said housing through said first orifice means to exit said housing;

(b) attaching the first end of a hose to said first orifice means, the second end of said hose being immersed in water in said swimming pool;

(c) pumping water from said swimming pool through said hose into said first orifice means, through said housing, and outwardly from said housing through said second orifice means; and, (d) holding said descaler apparatus adjacent said pool tile such that said reciprocating pins contact said tile and loosen scale therefrom.

* * * * *